US010184421B2

(12) United States Patent
Brandt et al.

(10) Patent No.: US 10,184,421 B2
(45) Date of Patent: Jan. 22, 2019

(54) ENGINE PISTON

(71) Applicant: Federal-Mogul Corporation, Southfield, MI (US)

(72) Inventors: Marc Brandt, Wixom, MI (US); Andrew J. Miller, Plymouth, MI (US)

(73) Assignee: Tenneco Inc., Lake Forest, IL (US)

( * ) Notice: Subject to any disclaimer, the term of this patent is extended or adjusted under 35 U.S.C. 154(b) by 0 days.

(21) Appl. No.: 13/795,361

(22) Filed: Mar. 12, 2013

(65) Prior Publication Data

US 2013/0233270 A1 Sep. 12, 2013

Related U.S. Application Data

(60) Provisional application No. 61/609,594, filed on Mar. 12, 2012.

(51) Int. Cl.
*F02F 3/00* (2006.01)
*F02F 3/16* (2006.01)

(52) U.S. Cl.
CPC ..... *F02F 3/00* (2013.01); *F02F 3/0076* (2013.01); *F02F 3/0084* (2013.01); *F02F 3/16* (2013.01); *F02F 2003/0007* (2013.01)

(58) Field of Classification Search
CPC ..... F02F 3/00; F02F 2003/0007; F05C 2201/0448; F16J 1/001; F16J 1/08
USPC ..... 123/193.6, 193.4, 41.35; 92/186, 208, 92/237
See application file for complete search history.

(56) References Cited

U.S. PATENT DOCUMENTS

| | | | | |
|---|---|---|---|---|
| 1,283,021 A | | 10/1918 | Anderson | |
| 1,719,092 A | * | 7/1929 | Taylor | F02F 3/027 92/209 |
| 2,177,574 A | | 10/1939 | Malina | |
| 2,514,016 A | * | 7/1950 | Casado | 123/193.4 |
| 2,991,769 A | * | 7/1961 | Chapin | 123/41.35 |

(Continued)

FOREIGN PATENT DOCUMENTS

| | | |
|---|---|---|
| CN | 1813125 A | 8/2006 |
| DE | 19734654 C1 | 8/1998 |

(Continued)

OTHER PUBLICATIONS

International Search Report, dated Jun. 24, 2013 (PCT/US2013/030315).

*Primary Examiner* — Marguerite McMahon
*Assistant Examiner* — James Kim
(74) *Attorney, Agent, or Firm* — Robert L. Stearns; Dickinson Wright, PLLC

(57) ABSTRACT

A piston for an internal combustion engine is provided. The piston includes a piston body of steel and including a crown portion, a pair of skirt portions and a pair of pin boss panels. The crown portion has an upper combustion surface, a lower surface having an undercrown surface area and an outer annular ring belt with at least one ring groove. The pin boss panels depend from the crown portion and extend in spaced relationship with one another between the skirt portions. Each pin boss panel includes a pin boss having a pin bore, and the pin bores are aligned with one another for receiving a wrist pin. Each pin boss panel also has at least one recess located vertically between the associated one of the pin bores and the crown portion to increase the undercrown surface area for improved cooling of the crown portion.

12 Claims, 6 Drawing Sheets

(56) References Cited

U.S. PATENT DOCUMENTS

| | | | | |
|---|---|---|---|---|
| 3,403,605 | A | 10/1968 | Schmidt | |
| 3,505,934 | A | 4/1970 | Biasse | |
| 3,987,709 | A | 10/1976 | Day | |
| 4,292,937 | A | 10/1981 | Vallaude | |
| 4,350,083 | A | 9/1982 | Gannaway | |
| 4,662,047 | A | 5/1987 | Berchem | |
| 4,683,808 | A | 8/1987 | Wacker et al. | |
| 4,704,950 | A | 11/1987 | Ripberger et al. | |
| 4,747,340 | A * | 5/1988 | Schellmann | F02F 3/0015 92/172 |
| 4,785,774 | A * | 11/1988 | Tokoro | F02F 3/025 123/193.6 |
| 4,856,417 | A | 8/1989 | Ishikawa | |
| 4,909,132 | A * | 3/1990 | Kling | F02F 3/0069 92/190 |
| 5,058,489 | A | 10/1991 | Iwaya | |
| 5,063,893 | A * | 11/1991 | Iwaya | F02F 3/0076 123/193.6 |
| 5,239,955 | A | 8/1993 | Rao et al. | |
| 5,313,919 | A | 5/1994 | Rao et al. | |
| 5,487,364 | A | 1/1996 | Takeda et al. | |
| 5,713,262 | A | 2/1998 | Sugiyama et al. | |
| 5,778,846 | A * | 7/1998 | Mielke | 123/193.6 |
| 5,839,351 | A | 11/1998 | Nakada | |
| 6,112,715 | A * | 9/2000 | Nigro | F02B 23/0672 123/193.6 |
| 6,152,016 | A | 11/2000 | Bahr et al. | |
| 6,152,017 | A | 11/2000 | Harrer et al. | |
| 6,240,828 | B1 | 6/2001 | Fujimoto | |
| 6,318,243 | B1 * | 11/2001 | Jones | F02F 3/0015 92/189 |
| 6,546,993 | B1 | 4/2003 | Tilch | |
| 6,659,063 | B2 | 12/2003 | Nomura et al. | |
| 6,840,156 | B1 * | 1/2005 | Gillman | F02F 3/0076 123/41.38 |
| 6,862,977 | B2 * | 3/2005 | Glinsner | F02F 3/0076 92/208 |
| 6,938,603 | B2 | 9/2005 | Scharp | |
| 7,104,183 | B2 | 9/2006 | Huang | |
| 7,305,960 | B2 | 12/2007 | Zvonkovic | |
| 7,406,941 | B2 | 8/2008 | Zhu et al. | |
| 7,458,158 | B2 | 12/2008 | Luo et al. | |
| 7,472,674 | B2 | 1/2009 | Robelet | |
| 7,503,304 | B2 | 3/2009 | Otsuka et al. | |
| 7,895,937 | B2 | 3/2011 | Frank et al. | |
| 7,954,421 | B2 | 6/2011 | Buschbeck et al. | |
| 8,082,839 | B2 | 12/2011 | Huang | |
| 8,485,088 | B2 * | 7/2013 | Feeser | B21K 1/18 29/888.04 |
| 8,528,513 | B2 | 9/2013 | Haug et al. | |
| 8,820,288 | B2 | 9/2014 | Kaiser et al. | |
| 2006/0150941 | A1 * | 7/2006 | Verbrugge et al. | 123/193.6 |
| 2008/0216790 | A1 * | 9/2008 | Breidenbach | F02F 3/0076 123/193.4 |
| 2008/0245229 | A1 | 10/2008 | Buschbeck et al. | |
| 2008/0264376 | A1 | 10/2008 | Braig et al. | |
| 2009/0020007 | A1 | 1/2009 | Lin et al. | |
| 2010/0065009 | A1 | 3/2010 | Mukouhara et al. | |
| 2010/0139480 | A1 * | 6/2010 | Ohmori | F02F 3/00 92/239 |
| 2010/0229820 | A1 | 9/2010 | Iwata et al. | |
| 2010/0307446 | A1 * | 12/2010 | Nodl | F02F 3/0076 123/193.6 |
| 2011/0113956 | A1 * | 5/2011 | Frank | F16J 1/001 92/208 |
| 2011/0139114 | A1 * | 6/2011 | Nakazawa | F02F 3/027 123/193.6 |
| 2011/0155092 | A1 | 6/2011 | Bischofberger | |
| 2011/0174153 | A1 | 7/2011 | Hettich et al. | |
| 2011/0265326 | A1 | 11/2011 | Lin et al. | |
| 2012/0024255 | A1 | 2/2012 | Grahle et al. | |
| 2012/0037112 | A1 | 2/2012 | Muscas | |
| 2012/0037115 | A1 | 2/2012 | Schnaiter et al. | |
| 2012/0080004 | A1 | 4/2012 | Menezes et al. | |
| 2012/0145112 | A1 | 6/2012 | Scharp | |
| 2012/0174899 | A1 | 7/2012 | Haug | |
| 2013/0008407 | A1 * | 1/2013 | Issler | F02F 3/00 123/193.6 |
| 2013/0062218 | A1 | 3/2013 | Michael et al. | |
| 2013/0146017 | A1 | 6/2013 | Muscas et al. | |
| 2013/0180494 | A1 | 7/2013 | Aharonov et al. | |
| 2013/0192556 | A1 | 8/2013 | Rothkegel | |
| 2013/0233270 | A1 | 9/2013 | Brandt et al. | |
| 2014/0076264 | A1 | 3/2014 | Matsuo et al. | |
| 2014/0083390 | A1 | 3/2014 | Azevedo et al. | |

FOREIGN PATENT DOCUMENTS

| | | | |
|---|---|---|---|
| DE | 102008035698 | A1 | 2/2010 |
| DE | 102012214681 | A1 | 2/2014 |
| EP | 0748931 | A1 | 12/1996 |
| JP | S5549040 | U | 3/1980 |
| JP | S5825642 | U | 2/1983 |
| JP | S60194149 | U | 12/1985 |
| JP | S6267939 | U | 4/1987 |
| JP | S63102925 | U | 7/1988 |
| JP | 6425446 | U | 2/1989 |
| JP | 0315650 | A | 1/1991 |
| JP | H03102042 | U | 10/1991 |
| JP | H0622549 | U | 3/1994 |
| JP | 6101566 | A | 4/1994 |
| JP | H06503627 | A | 4/1994 |
| JP | 06193733 | A | 7/1994 |
| JP | 06193734 | A | 7/1994 |
| JP | H08338302 | A | 12/1996 |
| JP | H11132101 | A | 5/1999 |
| JP | 2010509529 | A | 3/2010 |
| JP | 2010209862 | A | 9/2010 |
| JP | 2010223288 | A | 10/2010 |
| JP | 2011127609 | A | 6/2011 |

* cited by examiner

ENGINE PISTON

CROSS REFERENCE TO RELATED APPLICATION

This application claims the benefit of application Ser. No. 61/609,594 filed on Mar. 12, 2012.

BACKGROUND OF THE INVENTION

1. Field of the Invention

The present invention relates generally to pistons for internal combustion engines and more particularly to pistons made of steel.

2. Related Art

In their continuing efforts to improve power production and fuel efficiency, many engine manufactures are incorporating advanced technologies such as direct injection, turbochargers and super-chargers into their gasoline-fueled engines. Often, these and other advanced technologies improve the engine's performance by increasing the pressures and temperatures of combustion within the engine's cylinder bore. However, conventional aluminum pistons may not be able to perform adequately in these increased temperatures and pressures. In order to withstand and perform at the increased combustion temperatures and pressures, some piston manufacturers have taken to using steel to make their pistons. In order to cool their steel pistons, many piston manufacturers incorporate one or more oil galleries into their piston bodies to retain a cooling oil at or near the upper crown portions of their piston bodies.

SUMMARY OF THE INVENTION

An aspect of the present invention provides for a piston for an internal combustion engine. The piston includes a one piece piston body fabricated of steel and including a crown portion, a pair of diametrically opposed skirt portions depending from the crown portion and a pair of pin boss panels. The crown portion has an upper combustion surface, a lower surface with an undercrown surface area and an outer annular ring belt with at least one ring groove. The pin boss panels depend from the crown portion and extend in spaced relationship with one another between the skirt portions. Each pin boss panel includes a pin boss with a pin bore, and the pin bores are aligned with one another for receiving and supporting a wrist pin to a connect the piston body with a connecting rod. Each pin boss panel also has at least one recess located vertically between the associated one of the pin bores and the crown portion to increase the undercrown surface area. During operation of an engine, the increased undercrown surface area allows for improved cooling of the crown portion by providing a larger surface for receiving a jet of cooling oil which extracts heat from the crown portion.

According to another aspect of the present invention, the recess between the pin boss and the crown portion is a window to further increase the undercrown surface area and provide for further improved cooling of the crown portion during operation of the engine.

According to yet another aspect of the present invention, each pin boss panel includes a pair of side windows disposed adjacent to the window to still further increase the undercrown surface area and provide for even further improved cooling of the crown portion during operation of the engine.

According to still another aspect of the present invention, each of the skirt portions is generally trapezoidal in shape with the narrow dimension of the trapezoid being integrally connected with the ring belt of the crown portion. This provides for an additional increase in the undercrown surface area by exposing a greater length of a lower surface of the ring belt to the cooling oil and provides for still further improved cooling of the crown portion during operation of the engine.

According to a further aspect of the present invention, each of the skirt portions has a stiffening rib with an increased thickness which extends substantially between the pin boss panels and is located vertically at or below a pin bore axis that extends through the aligned pin bores. The stiffening ribs allow the skirt portions to have very thin walls and also have sufficient rigidity to withstand high combustion loads and to distribute the skirt loads.

BRIEF DESCRIPTION OF THE DRAWINGS

These and other features and advantages of the present invention will be readily appreciated, as the same becomes better understood by reference to the following detailed description when considered in connection with the accompanying drawings wherein.

DESCRIPTION OF THE ENABLING EMBODIMENT

Figure 1:
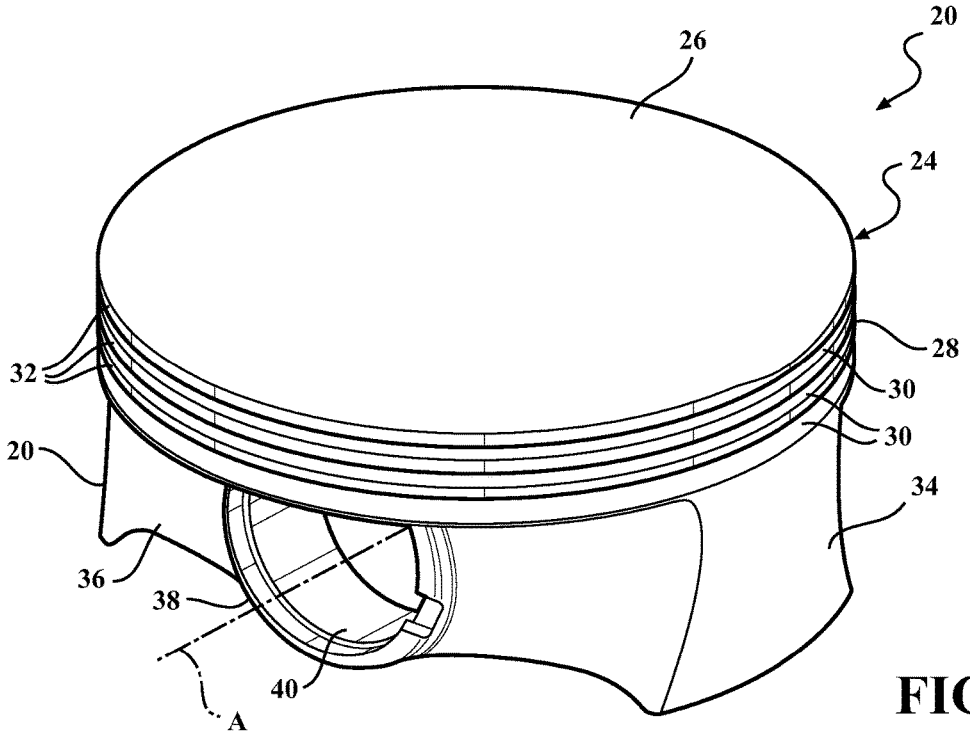
FIG. 1 is an upper perspective view of a first exemplary embodiment of a piston body.
Figure 2:
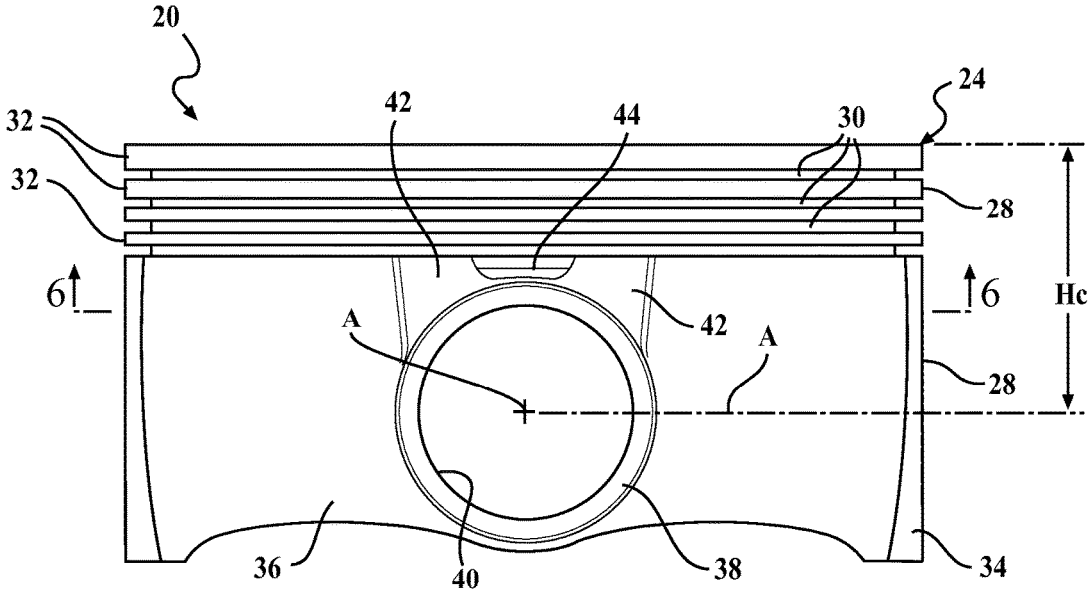
FIG. 2 is a side elevation view of the first exemplary embodiment of the piston body.

Referring to the Figures, wherein like numerals indicate corresponding parts throughout the several views, a first exemplary embodiment of a piston for an internal combustion engine is generally shown in FIG. 1. The piston has a one piece piston body 20 which is formed of steel and is dimensionally compact to have a very low weight. Additionally, the piston body 20 is designed to maximize an undercrown surface area for optimized cooling of the piston body 20 with a flow of cooling oil from below. This allows for the piston body 20 to operate in the increased combustion temperatures and pressures of modern internal combustion engines. The piston body 20 is preferably configured for use in gasoline fueled spark ignition four stroke internal combustion engines but could alternately be used in diesel fueled engines, two stroke engines, and/or compression ignition engines.

Figure 3:
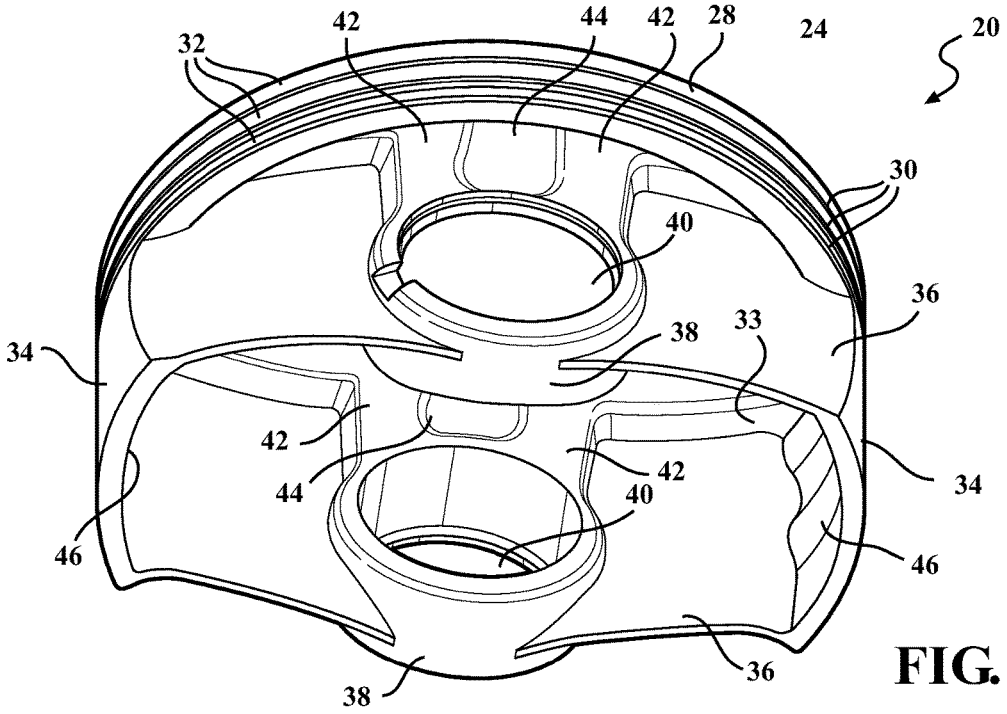
FIG. 3 is a lower perspective view of the first exemplary embodiment of the piston body.

Referring still to FIG. 1, the one piece piston body 20 has a crown portion 24 with an upper combustion surface 26 and an outer annular ring belt 28 with a plurality of ring grooves 30 (three being shown in the exemplary embodiment) for receiving piston rings (not shown) to establish a seal between the piston body 20 and a cylinder wall (not shown). As best shown in FIG. 3, the ring grooves 30 are spaced vertically from one another by lands 32. The lower surface of the crown portion 24 is an undercrown surface 33 which, during operation of the engine, receives a jet of cooling oil to cool the piston body 20. During operation of the engine, the upper combustion surface 26 of the crown portion 24 is the portion that is directly exposed to the combustion of fuel and air within a combustion cylinder of the engine, and therefore, it is desirable to maximize the area of the undercrown surface 33 to maximize the transfer of heat to the cooling oil and away from the crown portion 24. As best shown in FIG. 1, in the first exemplary embodiment, the upper combustion surface 26 is generally flat. However, it should be appreciated that the upper combustion surface 26 could alternately be provided with a combustion bowl or any desirable feature or features.

The piston body 20 also includes a pair of diametrically opposed skirt portions 34 which extend downwardly from the ring belt 28 of the crown portion 24. The skirt portions 34 of the exemplary embodiment are generally trapezoidal in shape with a narrower dimension at the upper end, which is integrally connected with the ring belt 28, and a wider dimension at the lower end. During operation of the engine, having the narrow dimension at the upper end increases the undercrown surface area of the crown portion 24 by exposing a greater length of the bottom of the ring belt 28 to the jet of cooling oil, thereby increasing the transfer of heat from the crown portion 24 to the cooling oil. In the first exemplary embodiment of the piston body 20, the narrower upper end of each skirt portion 34 blends generally smoothly with the outer wall surface of the ring belt 28 of the crown portion 24.

Figure 5:
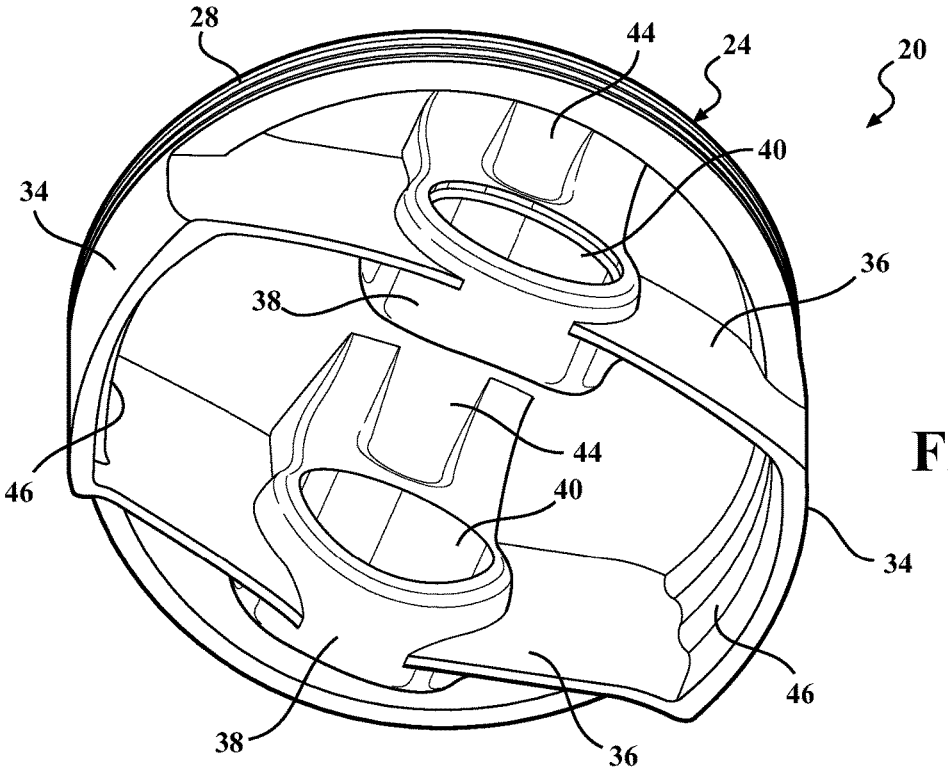
FIG. 5 is yet another lower perspective view of the first exemplary embodiment of the piston body taken from a different angle from FIGS. 3 and 4.

The piston body 20 further includes a pair of pin boss panels 36 which depend from the crown portion 24 and extend downwardly therefrom. The pin boss panels 36 are spaced from one another and extend in a generally linear fashion between adjacent ends, or edges, of the skirt portions 34. A pin boss 38 extends through each of the pin boss panels 36, and each pin boss 38 has a pin bore 40. The pin bores 40 are aligned with one another along a pin bore axis A for receiving and supporting a wrist pin (not shown) to couple the piston body 20 with a connecting rod (not shown) in an internal combustion engine. As shown in FIG. 5, each pin bores 40 extend along the pin bore axis A by a width which is greater than the width of the adjacent portions 24, 34 of the pin boss panels 36. Each pin boss panel 36 also includes a support feature 42 which extends vertically upwardly from the pin boss 38 to the undercrown surface 33 of the crown portion 24 to provide additional support for the pin bosses 38. The pin bosses 38 preferably have a thickness of approximately 2 to 4% of the outer diameter D of the piston body 20.

The vertical distance between the upper combustion surface 26 on the crown portion 24 and the pin bore axis A, a measurement which is commonly known as compression height $H_C$, is preferably in the range of 25 to 35% of the outer diameter D of the piston body 20. As such, the piston body 20 is very low profile as compared to many conventional pistons. The lack of any cooling galleries, which are found on many conventional steel pistons, contributes to the low profile of the piston body 20 of the first exemplary embodiment. Additionally, the thickness of the crown portion 24 is preferably in the range of 5 to 10% of the compression height $H_C$, the lower length of the skirt portion 34 (the distance from the bottom of the skirt to the pin bore axis A) is preferably in the range of 50 to 60% of the compression height $H_C$, and at least one of the lands 32 in the ring belt 28 preferably has a height in the range of 2 to 5% of the compression height $H_C$.

Figure 6:
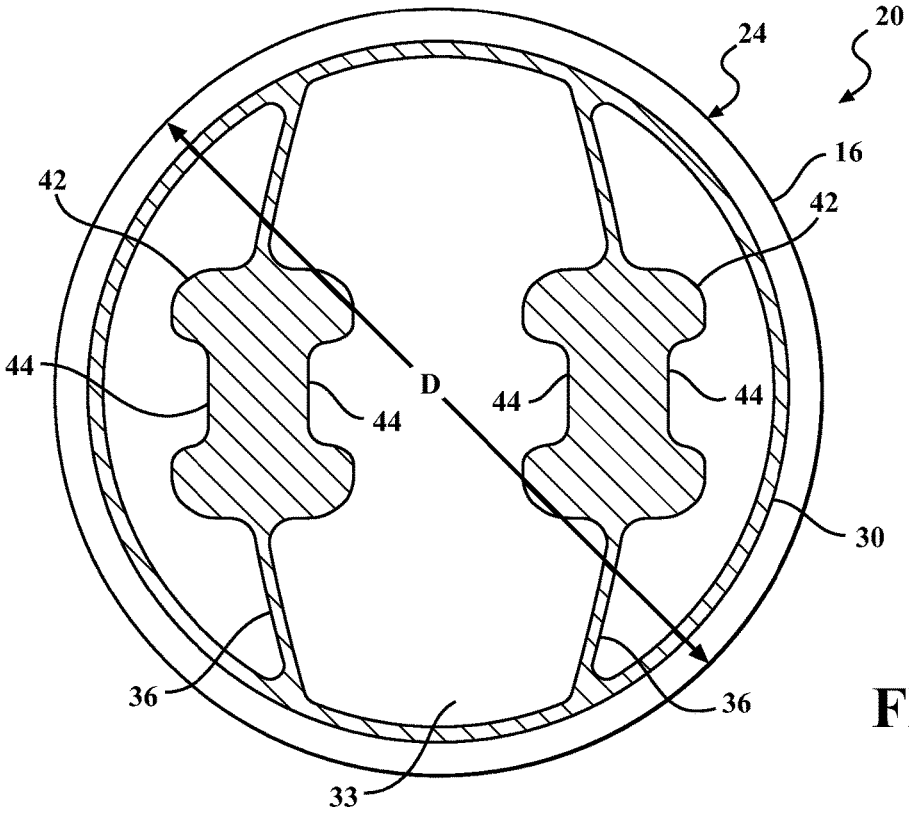
FIG. 6 is a cross-sectional view of the first exemplary embodiment of the piston body taken through line 6-6 of FIG. 4.

Referring still to FIG. 5, the pin boss panels 36 are undercut to provide a recess 44 above the pin boss 38 bores and below the crown portion 24 to increase the undercrown surface 22 area, thereby increasing the transfer of heat from the crown portion 24 to the cooling oil during operation of the engine. In addition to increasing the undercrown surface area, the recesses 44 also reduce the total weight of the piston body 20, which leads to other performance advantages, and reduce the material costs of the piston body 20. Preferably, the undercrown surface area is greater than or equal to $0.5*D^2*\pi/4$ with D being the outer diameter D (shown in FIG. 6) of the piston body 20. In the first exemplary embodiment of the piston body 20, each pin boss panel 36 has recesses 44 on both its inner and outer surfaces to further increase the undercrown surface area.

Figure 4:
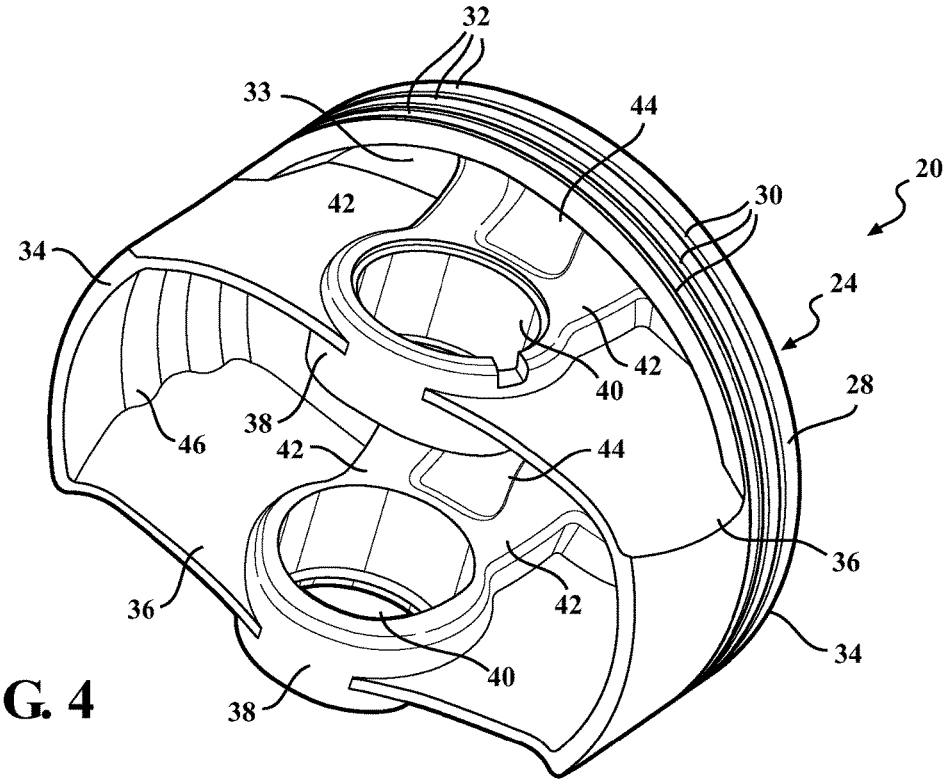
FIG. 4 is another lower perspective view of the first exemplary embodiment of the piston body taken from a different angle from FIG. 3.

As best shown in FIG. 4, the skirt portions 34 are thin walled and preferably have a thickness in the range of 1.5 to 5% of the outer diameter D of the piston body 20. This provides for reduced weight in the piston body 20 and also reduced material costs when making the piston body 20. Additionally, each of the skirt portions 34 has a stiffening rib 46 with an increased thickness for structurally reinforcing the skirt portions 34. The stiffening ribs 46 are preferably generally planar with or vertically below the pin bore axis A to provide the structural reinforcement in a lower area of the piston body 20. As such, the stiffening ribs 46 allow the skirt portions 34 to have very thin walls but with sufficient rigidity to support high combustion loads and distribute the skirt loads. Preferably, the middle areas of the stiffening ribs 46 are positioned approximately zero to ten millimeters (0-10 mm) below the pin bore axis A. The stiffening ribs 46 extend in a circumferential direction along the length of the skirt portions 34 and between the pin boss panels 36.

Figure 7:
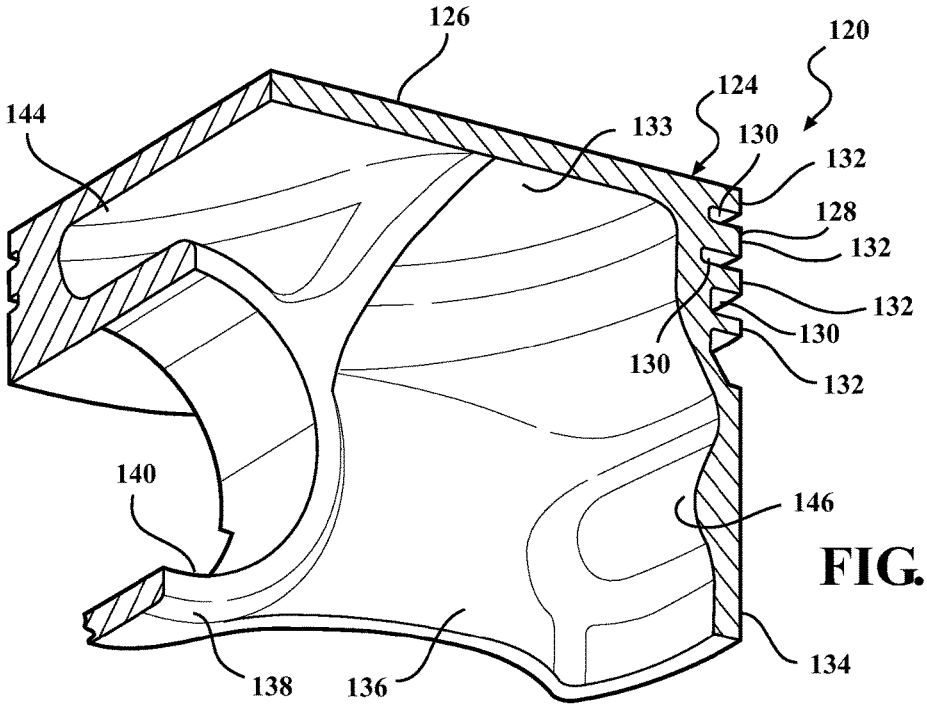
FIG. 7 is a perspective, fragmentary and sectional view of a second exemplary embodiment of the piston body.

Referring now to FIG. 7, a second exemplary embodiment of the piston body 120 is generally shown with like numerals, separated by a factor of 100, indicating corresponding parts with the first exemplary embodiment described above. In this exemplary embodiment, the pin boss panels 136 each have only a single recess 144, and each recess 144 extends the full width of the corresponding pin boss 138 and is closed at its outer side by the ring belt 128.

Figure 8:
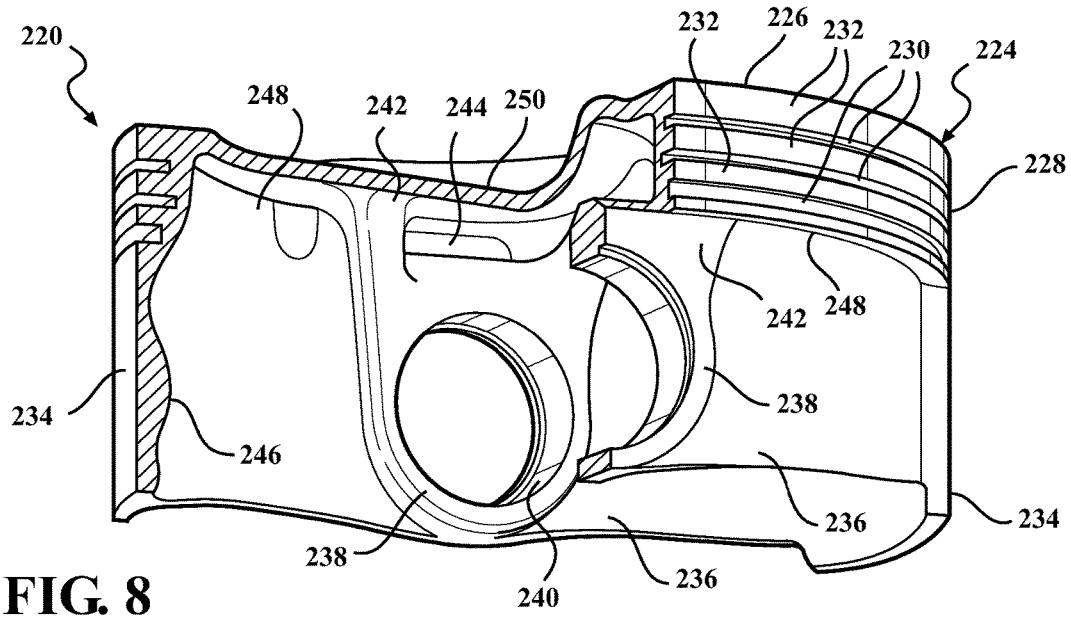
FIG. 8 is a perspective, fragmentary and sectional view of a third exemplary embodiment of the piston body.
Figure 9:
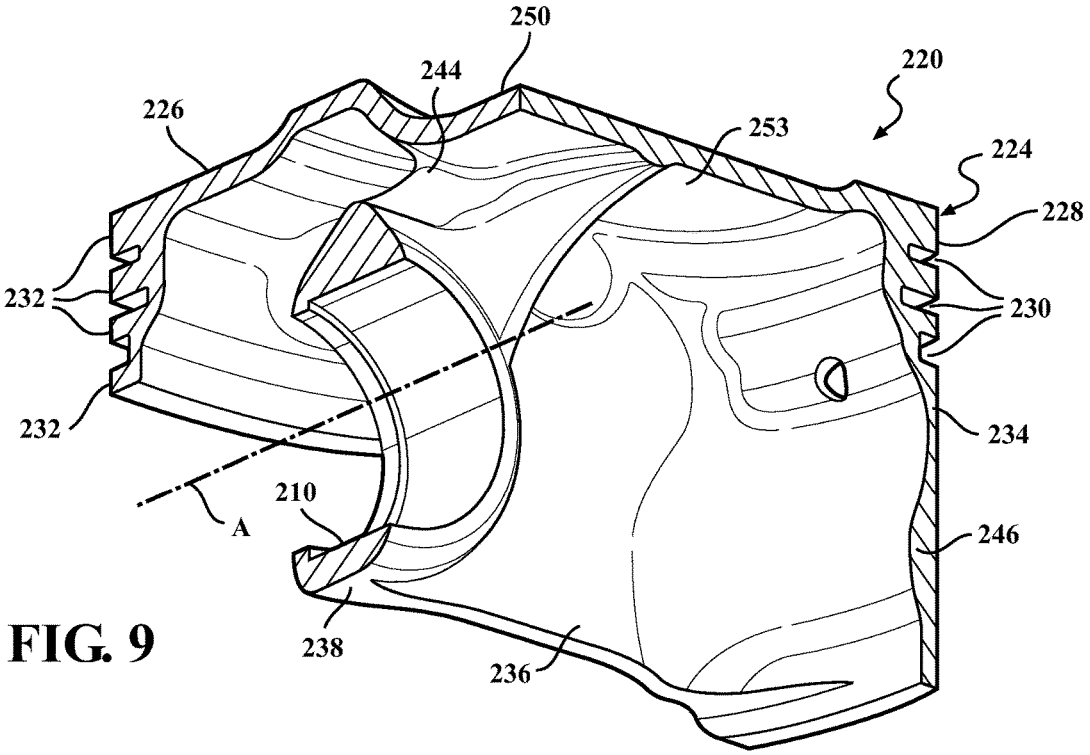
FIG. 9 is another perspective, fragmentary and sectional view of the third exemplary embodiment of the piston body.

Referring now to FIGS. 8 and 9, a third exemplary embodiment of the piston body 220 is generally shown with like numerals, separated by a factor of 200, indicating corresponding parts with the first exemplary embodiment described above. In this exemplary embodiment, the recesses 244 on the pin boss panels 236 are central windows 244 which extend entirely through the pin boss panels 236. This embodiment also includes a pair of side windows 248 spaced on opposite side of the central windows 244. As with the central windows 244, the side windows 248 extend vertically to the undercrown surface 233 of the crown portion 24, thereby increasing the undercrown surface area as compared to the first and second exemplary embodiments. As shown, the central windows 244 and the side windows 248 are substantially entirely disposed vertically above the pin bores 240. Additionally, the upper combustion surface 226 of this exemplary embodiment is formed with a combustion bowl 250.

Figure 10:
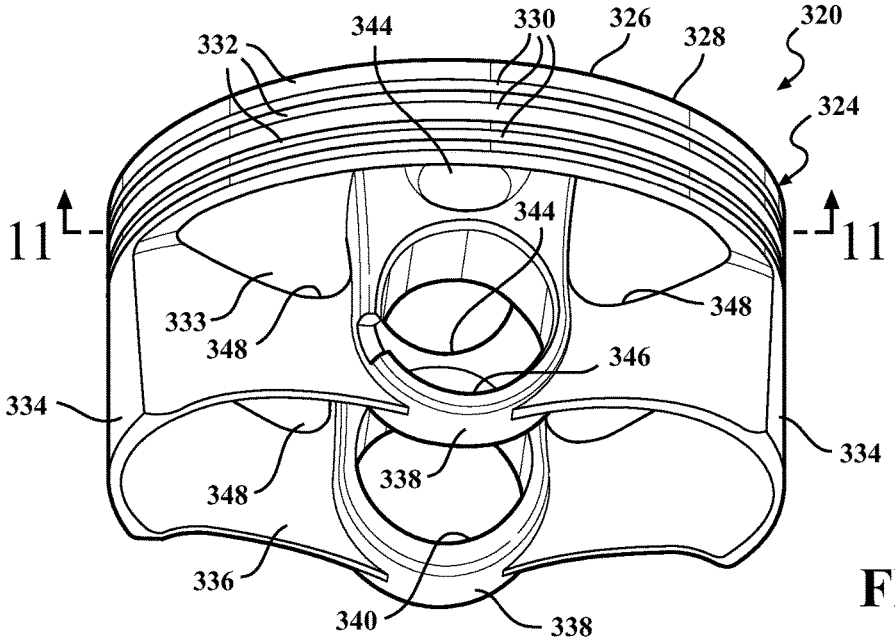
FIG. 10 is a lower perspective view of a fourth exemplary embodiment of the piston body.
Figure 11:
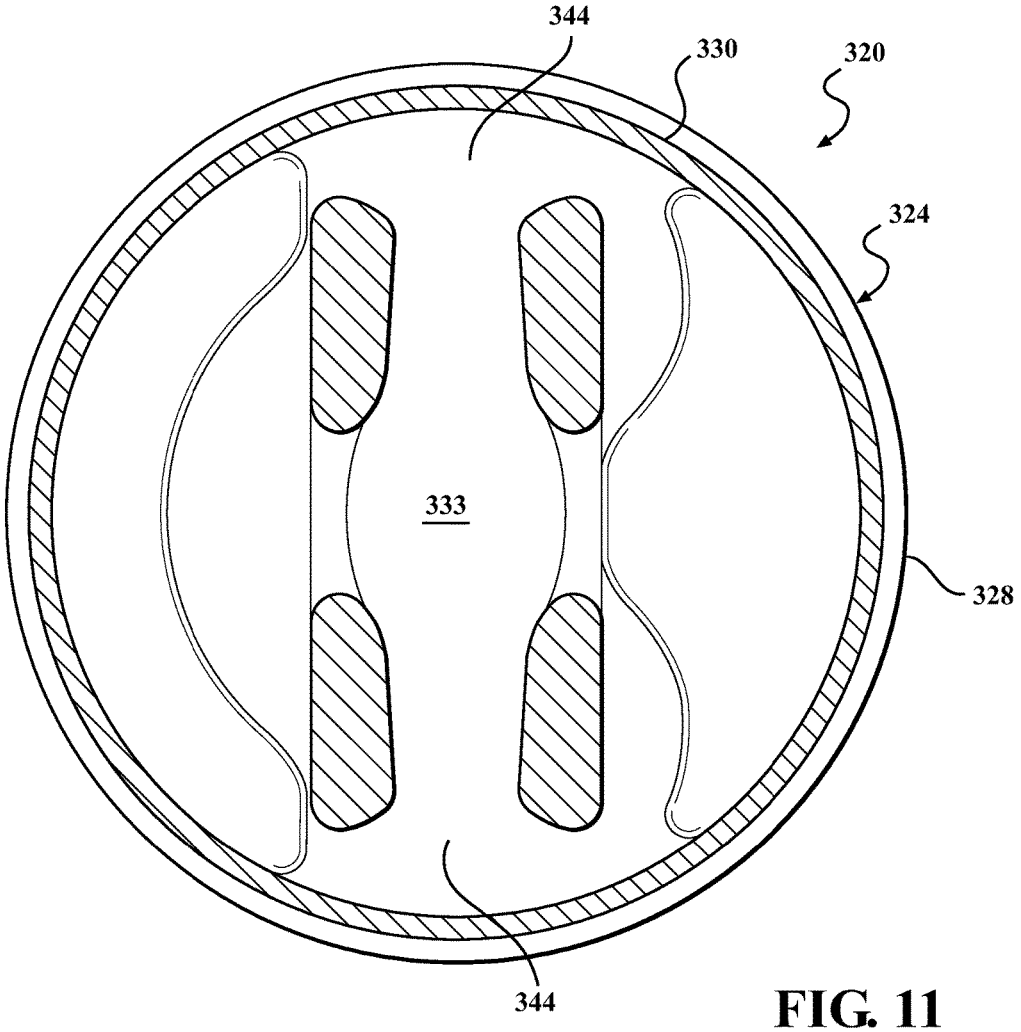
FIG. 11 is a cross-sectional view of the fourth exemplary embodiment of the piston body taken through line 11-11 of FIG. 10.

Referring now to FIGS. 10 and 11, a fourth exemplary embodiment of the piston body 320 is generally shown with like numerals, separated by a factor of 300, indicating corresponding parts with the first exemplary embodiment described above. The fourth exemplary embodiment is similar to the third exemplary embodiment but the side windows 348 are greatly increased in size and they extend vertically to below the tops of the pin bores 340. This further increases the undercrown surface area as compared to the first, second and third exemplary embodiments. Like the third exemplary embodiment discussed above, the fourth exemplary embodiment also includes a combustion bowl 350 in the upper combustion surface 326.

The use of steel allows the piston bodies 20, 120, 220, 320 of the above-discussed embodiments to perform in higher combustion pressures and temperatures as compared to aluminum piston bodies and also for higher pin boss loading and smaller wrist pins. The use of steel also allows for thinner walls, and as such, the masses of the exemplary steel piston bodies 20, 120, 220, 320 are comparable to aluminum pistons. Unlike conventional steel pistons, the steel piston bodies 20, 120, 220, 320 of the exemplary embodiments do not have any oil galleries. Rather than with cooling galleries, the needed cooling is achieved by the high undercrown surface area to receive a jet of cooling oil. The lack of cooling galleries also allows the piston bodies 20, 120, 220, 320 to have a much smaller compression height $H_C$ as compared to conventional steel pistons.

The piston body 20, 120, 220, 320 may be formed through any suitable forming process or combination of forming processes including, for example, casting, forging, machining from a billet, etc. The piston body 20, 120, 220, 320 may also be put through one or more heat treating operations, if desired.

The foregoing description is exemplary rather than limiting in nature. Variations and modifications to the disclosed embodiments may become apparent to those skilled in the art are herein incorporated within the scope of the invention.

What is claimed is:

1. A piston for an internal combustion engine, comprising:

a one piece piston body extending along a central axis and fabricated of steel and including a crown portion, a pair of diametrically opposed skirt portions depending from said crown portion, and a pair of pin boss panels, said one piece piston body being without a cooling gallery between said opposed skirt portions;

said crown portion having an upper combustion surface and a lower surface having an undercrown surface area and an outer annular ring belt with at least one ring groove, and said undercrown surface area having an inboard portion between said pin boss panels and a pair of outboard portions on opposite sides of said pin boss panels from said inboard portion;

said upper and lower combustion surfaces, said ring belt, said pin boss panels and said skirt portions being fabricated of one single piece of said steel;

said pin boss panels depending from said top wall of said crown portion and extending in spaced relationship with one another between said skirt portions, each pin boss panel including a pin boss having a pin bore, said pin bores being aligned with one another for receiving a wrist pin, and each pin boss panel presenting at least one recess located between the associated one of said pin boss bores and said crown portion to increase said undercrown surface area for improved cooling of said crown portion;

wherein said crown portion has an outer diameter and said undercrown surface area is at least $0.5*D^2*\pi/4$ where D is said outer diameter of said crown portion;

wherein said piston has a compression height that is in the range of 25 to 35% of said outer diameter;

wherein each of said skirt portions has a stiffening rib which extends only from one of said pin boss panel to the other pin boss panel such that opposite ends of the stiffening rib are spaced from the pin bosses; and wherein each of said skirt portions has a pair of thin regions on opposite axial sides of said stiffening rib and wherein each of said thin regions has a thickness in the range of 1.5 to 5% of said outer diameter to further increase said undercrown surface area for improved cooling of said crown portion.

2. The piston as set forth in claim 1 wherein said at least one recess on each pin boss panel is a single recess, is on an inner surface, and extends substantially the entire length of the adjacent pin boss.

3. The piston as set forth in claim 1 wherein said at least one recess on each pin boss panel is further defined as a pair of recesses with one of said recesses being on an inner surface of said pin boss panel and the other of said recesses being on an outer surface of said pin boss panel to further increase said under crown surface area.

4. The piston as set forth in claim 1 wherein said at least one recess on each pin boss panel is a central window that extends between inner and outer surfaces of said pin boss panel to further increase said under crown surface area.

5. The piston as set forth in claim 4 wherein each of said pin boss panels further includes a pair of side windows disposed on either side of said central window to further increase said under crown surface area.

6. The piston as set forth in claim 5 wherein said side windows extend vertically below top portions of said pin bores.

7. The piston as set forth in claim 1 wherein said crown portion has an outer diameter and said piston body has a compression height that is in the range of 25 to 35% of said outer diameter of said crown portion.

8. The piston as set forth in claim 1 wherein said pin bores are aligned with one another by a pin bore axis and wherein said stiffening rib is at or below said pin bore axis.

9. The piston as set forth in claim 8 wherein said stiffening rib is 0-10 mm below said pin bore axis.

10. The piston as set forth in claim 1 wherein said skirt portions are generally trapezoidal in shape with a narrow dimension being integrally connected with said ring belt.

11. The piston as set forth in claim 1 wherein said pin boss panels extend between adjacent ends of said skirt portions.

12. The piston as set forth in claim 1 wherein said piston body is without any oil galleries.

* * * * *